US006120102A

United States Patent [19]

Buono

[11] Patent Number: 6,120,102

[45] Date of Patent: Sep. 19, 2000

[54] BODY WASHER AND EXFOLIATOR

[75] Inventor: Ralph Buono, Homebush, Australia

[73] Assignee: Buono-Net Australia Pty Limited, Homebush, Australia

[21] Appl. No.: 09/131,489

[22] Filed: Aug. 10, 1998

[30] Foreign Application Priority Data

Aug. 13, 1997 [AU] Australia ..... PO8531

[51] Int. Cl.[7] ..... A47L 17/08; A47K 7/02

[52] U.S. Cl. ..... 300/21; 15/209.1; 15/229.11

[58] Field of Search ..... 15/209.1, 229.11; 300/21

[56] References Cited

U.S. PATENT DOCUMENTS

| | | | |
|---|---|---|---|
| 1,737,247 | 11/1929 | Kean . | |
| 4,168,863 | 9/1979 | Hatcher | 300/21 |
| 4,206,948 | 6/1980 | Shimizu | 300/21 |
| 5,465,452 | 11/1995 | Girardot | 15/209.1 |
| 5,713,094 | 2/1998 | Marker | 15/229.11 |

*Primary Examiner*—Randall E. Chin
*Attorney, Agent, or Firm*—Abelman, Frayne & Schwab

[57] ABSTRACT

A body washer and exfoliator (14) has at least two tubular nets (16, 18, 20) that are formed of distortable plastic material and that are located one inside the other and gathered together at a point so as to form, by the application of heat at and around that point, a sinuous ball like structure.

13 Claims, 2 Drawing Sheets

BODY WASHER AND EXFOLIATOR

FIELD OF INVENTION

The present invention relates to a body washer and exfoliator, being of particular use to persons having a shower or bath.

BACKGROUND ART

Body washers and exfoliators come in many different shapes and sizes. Among these are the commonly used brushes, straps, sponges, loofahs and rock scrubbers. More recently, netting has been used to form a washer of a sinuous ball like structure. However, net washers of this structure are easily disrupted by the rubbing and washing action and, over time, lose their shape and strength. Furthermore, these net washers are not sufficiently rigid for tough skin that may require vigorous scrubbing, such as on the upper back of a male person, to achieve an effective exfoliating action.

It is an object of the present invention to overcome or substantially ameliorate the shortcomings and disadvantages of the prior art.

SUMMARY OF THE INVENTION

According to the invention, there is provided a body washer and exfoliator comprising at least two tubular nets that are formed of distortable plastic material and that are located one inside the other and gathered together at a point so as to form, by the application of heat at and around that point, a sinuous ball like structure.

Preferably, the number of tubular nets equals three, and the tubular nets are formed by extrusion.

BRIEF DESCRIPTION OF THE DRAWINGS

In order that the invention may be readily understood and put into practical effect, reference will be made to the accompanying drawings, in which.

DETAILED DESCRIPTION OF THE INVENTION

Figure 1:
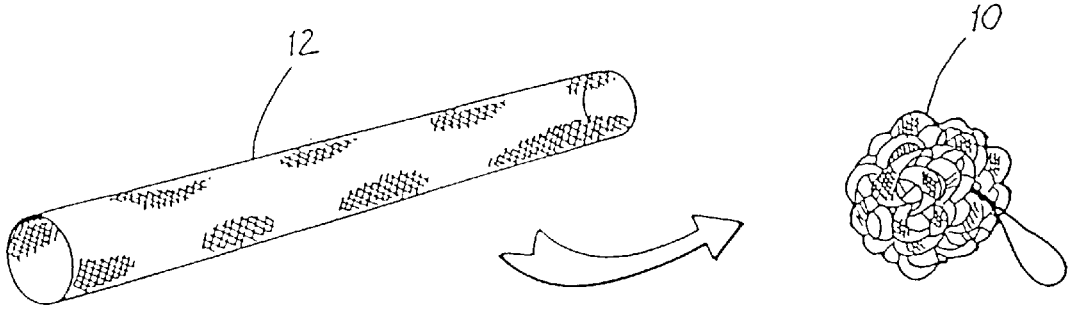
FIG. 1 PRIOR ART
FIG. 1. shows a single tubular net, and a body washer of the prior art produced therefrom, FIG. 2. shows three tubular nets, and a preferred body washer and exfoliator of the present invention produced therefrom, FIG. 3. is a perspective view of the three tubular nets shown in FIG. 2 being inserted one within the other to produce a concentric arrangement in accordance with a step in the process for producing the body washer and exfoliator of FIG. 2, FIG. 4. is a front elevational view of a frame and a portion of a concentric arrangement of the three tubular nets shown in FIG. 3 being stretched and fitted onto the frame in accordance with another step in the process for producing the body washer and exfoliator of FIG. 2, FIG. 5. is a view similar to that of FIG. 4, but in which the stretched and fitted concentric arrangement of nets is being gathered together in accordance with yet another step in the process for producing the body washer and exfoliator of FIG. 2, FIG. 6. is a view similar to that of FIG. 5, but in which the gathered concentric arrangement of nets is having hot air applied to the centre of the "gather" in accordance with a further step in the process for producing the body washer and exfoliator of FIG. 2, and FIG. 7. is a view similar to that of FIG. 6, but in which the hot air treated "gather" is being tied tightly around its centre by a tie means so as to provide a constricted neck portion in accordance with a still further step in the process for producing the body washer and exfoliator of FIG. 2.

The prior art body washer 10 shown in FIG. 1 is made from a single net 12 of a soft polymer based material which has been formed into a sinuous ball like tertiary structure. As a result, the body washer 10 may be crumpled easily by application of hand pressure to its tertiary structure, so forming a distorted, irregular tertiary structure that may be ineffective for certain circumstances of use by persons having a shower or bath, as described in the earlier discussion of the prior art.

An approach to overcoming this problem has been to select a harder but less distortable material for making the single net. Another approach has been to make the body washer smaller in overall diameter for the same length of net by not applying any heat during the formation of the washer, and thereby avoiding release of the elasticity of the netting which would otherwise contribute to a larger and less dense tertiary structure, such as that possessed by the washer in FIG. 1.

Figure 2:
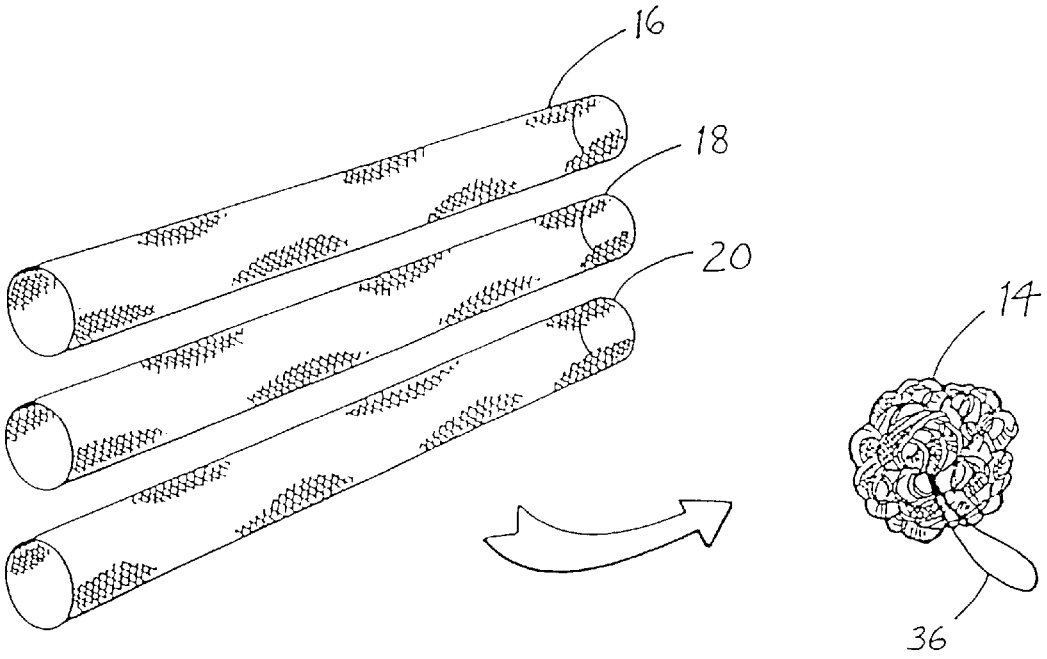

The body washer and exfoliator 14 of FIG. 2 has as large a diameter as the washer 10, but is denser and more rigid, without utilizing a net material that is any harder then that which may be used for the washer 10. The body washer and exfoliator 14 is, in this instance, produced from three tubular nets as also shown in FIG. 2.

The three tubular nets 16, 18, 20 are each of a different colour to suit market tastes and have an unstretched diameter of, say, 15 cm. They are separately extruded and cut to a desired length of, say, 1.5 meters (although this length may vary from 1 meter and upwards). Each net 16, 18 and 20 is made from 48% EVA polymer, 48% low density polymer, and 4% "super slip" additive.

Figure 3:
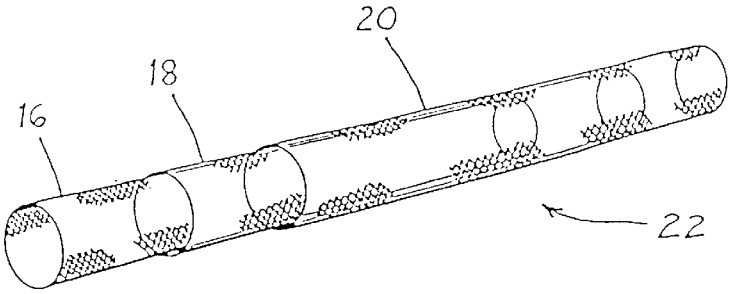
Figure 4:
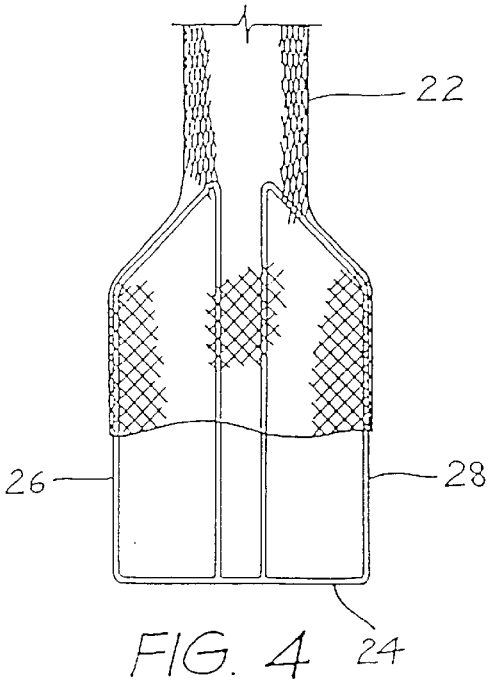

As shown in FIG. 3, the three tubular nets 16, 18, 20 are then inserted one within the other to produce a concentric arrangement 22 of three equal length tubular nets, The concentric arrangement 22 is then stretched and fitted onto a metal frame 24 by pulling the arrangement 22 downwardly over the two opposed upright portions 26, 28 as shown in FIG. 4. The shape and construction of the frame 24 may vary so as to suit the particular netting material that is used, and so as to facilitate the various steps in the process that utilize the frame 24.

Figure 5:
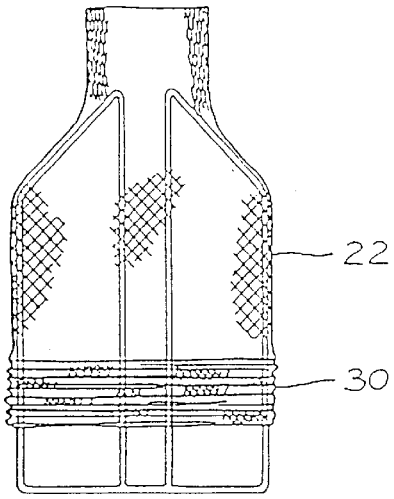
Figure 6:
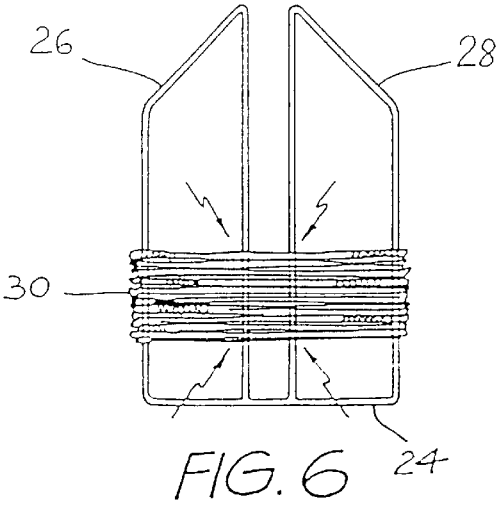
Figure 7:
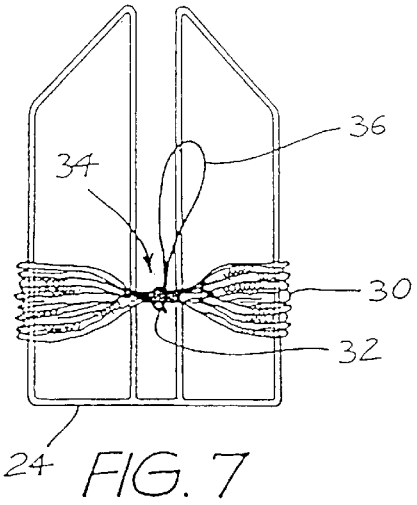

As shown in FIG. 5, the concentric arrangement 22 is then gathered together over the metal frame 24 which may vary in width from about 22 cm to about 30 cm so as to provide for different sizes of net. As an alternative to the aforementioned, the metal frame 24 may be used both as a template for the step of inserting the nets 16, 18, 20 one within the other, and as aforementioned, for the purpose of gathering together the concentric arrangement. Whilst the concentric arrangement 22 is in a gathered state on the metal frame, hot air is applied to the centre of the "gather" 30, as shown in FIG. 6, in order to release the elasticity of the netting at approximately 3 cm from either side of the centre of the "gather" 30.

A synthetic string or other tie means 32 is tied tightly around the centre of the "gather" 30 to provide a constricted neck portion 34 and a means for attaching a hand grip cord 36 or the like thereto. The hand grip cord 35 may be used for holding the body washer and exfoliator 14 or for hanging it from a hook in the shower or bath.

The heat treated and tied "gather" 30 is then drawn out from within the confinement of the metal frame 24 and its sinuous ball like structure, as shown by the body washer and exfoliator 14 in FIG. 2, is allowed to form by unrestricted elastic expansion.

Various modifications may be made in details of design and construction, as well as the process, without departing from the scope and ambit of the invention.

I claim:

1. A process for forming a body washer and exfoliator having a sinuous ball-like structure comprising the steps of:

(a) providing at least two tubular nets that are formed of distortable plastic material, each of said nets having a longitudinal axis;

(b) locating a first one of said nets in concentric relationship to a second one of said nets to produce a concentric arrangement of said tubular nets, said concentric arrangement having a common longitudinal axis;

(c) stretching said concentric arrangement transversely to said common longitudinal axis;

(d) gathering together said concentric arrangement of the stretched tubular nets of step (c) to form a stretched gather having a center with opposed sides;

(e) applying hot air to the center of the stretched gather sufficient to release the elasticity of a region of said nets at either side of the center;

(f) applying a tie means around the center of the stretched gather to provide a constricted neck portion of said stretched gather; and (g) releasing said stretched gather from its stretched state to allow a sinuous ball-like structure to form.

2. The process according to claim 1 wherein one or more additional tubular nets are arranged concentrically with respect to the first and second tubular nets.

3. The process according to claim 1 wherein steps (c) and (f) are carried out while said concentric arrangement and said stretched gather are fitted onto a template.

4. The process according to claim 3 wherein said template is a metal frame having two opposed upright portions and said concentric arrangement is stretched and gathered together by pulling said concentric arrangement downwardly over said two opposed upright portions.

5. A process for forming a body washer and exfoliator having a sinuous ball-like structure comprising the steps of:

(a) providing at least two tubular nets that are formed of distortable plastic material, each of said nets having a longitudinal axis;

(b) stretching a first one of said nets transversely to its longitudinal axis;

(c) stretching a second one of said nets transversely to its longitudinal axis and locating the stretched second one of said nets in concentric relationship to the stretched first one of said nets to produce a concentric arrangement of the stretched tubular nets, said concentric arrangement having a common longitudinal axis;

(d) gathering together said concentric arrangement of the stretched tubular nets of step (c) to form a stretched gather having a center with opposed sides;

(e) applying hot air to the center of the stretched gather sufficient to release the elasticity of a region of said nets at either side of said center;

(f) applying a tie means around the center of the stretched gather to provide a constricted neck portion of said stretched gather; and (g) releasing said stretched gather from its stretched state to allow a sinuous ball-like structure to form.

6. The process according to claim 5 wherein one or more additional tubular nets are arranged concentrically with respect to the first and second tubular nets.

7. The process according to claim 5 wherein steps (b) to (f) are carried out while said concentric arrangement and said stretched gather are fitted onto a template.

8. The process according to claim 7 wherein said template is a metal frame having two opposed upright portions and said concentric arrangement of the stretched tubular nets is produced by pulling each of the said nets downwardly over said two opposed upright portions.

9. A body washer and exfoliator comprising:

(a) at least two tubular nets that are formed of distortable plastic material and that are located one inside the other in the form of a sinuous ball-like structure, each of said nets arranged concentrically with respect to the other net to produce a concentric arrangement of said nets with a common longitudinal axis, said concentric arrangement having been stretched transversely with respect to said common longitudinal axis, said concentric arrangement of the stretched nets having been gathered together to form a stretched gather having a center with opposed sides, said center having had hot air applied thereto sufficient to release the elasticity of a region of said nets at either side of said center, (b) a heat treated region of said nets at either side of said center that has had its elasticity released by the application of hot air to the said centre, and (c) a tie means applied around said center to provide a constricted neck portion which, when the stretched gather is released from its stretched state, allows said nets to form a sinuous ball-like structure.

10. The bode washer and exfoliator according to claim 9 wherein said heat treated region of the nets is at approximately 3 cm from either side of said center.

11. The body washer and exfoliator according to claim 9 wherein said tie means comprises a synthetic string tied tightly around said center.

12. A body washer and exfoliator formed by a process in accordance with claim 1.

13. A body washer and exfoliator formed by a process in accordance with claim 5.

* * * * *